United States Patent [19]

Grelsson

[11] 4,434,709

[45] Mar. 6, 1984

[54] AXIAL PISTON PUMP

[76] Inventor: Bo L. Grelsson, Kantarellvägen 5, S-860 21 Sundsbruk, Sweden

[21] Appl. No.: 197,095

[22] PCT Filed: Feb. 22, 1980

[86] PCT No.: PCT/SE80/00050

§ 371 Date: Oct. 23, 1980

§ 102(e) Date: Oct. 10, 1980

[87] PCT Pub. No.: WO80/01822

PCT Pub. Date: Sep. 4, 1980

[30] Foreign Application Priority Data

Feb. 23, 1979 [SE] Sweden ..... 7901669

[51] Int. Cl.[3] ..... F01B 13/04

[52] U.S. Cl. ..... 91/506

[58] Field of Search ..... 91/504–506, 91/6.5; 417/222

[56] References Cited

U.S. PATENT DOCUMENTS

| | | | |
|---|---|---|---|
| 3,808,952 | 5/1974 | Knaak | 91/505 |
| 3,915,069 | 10/1975 | Wagenseil | 91/504 |
| 4,007,662 | 2/1977 | Deininger | 91/504 |

FOREIGN PATENT DOCUMENTS

| | | | |
|---|---|---|---|
| 2522718 | 2/1976 | Fed. Rep. of Germany | 91/505 |

*Primary Examiner*—William L. Freeh

*Attorney, Agent, or Firm*—William A. Drucker

[57] ABSTRACT

Axial piston pump comprising a rotatable cylinder block (16) within which at least one piston (20) is mounted slidable in a cylinder (18) and by rotation of the cylinder block is imparted a reciprocating movement by becoming inclined from a neutral or null position in which no pumping is effected, relatively a drive plate (14) in at least one direction. A distribution plate (22) adjustable jointly with the cylinder block (16) is formed with outlet and inlet slots (24,26) which by the inclination adjustment are caused to communicate with exhaust and intake ports (A,B) for the outflow and the reflux, respectively, of the pumped medium, which ports are formed in a stationary port plate (28). The port plate (28) has, in addition, at least one feed opening (32) for supply of pressure fluid to the pump. The exhaust and intake ports (A, B) and the feed opening (32) are so positioned in the stationary port plate (28) that the outlet and inlet slots (24,26) of the distribution plate as a consequence of increased inclination of the distribution plate from null position are brought to gradually increasing communication with the feed opening (32) and the exhaust port (A or B) for the outflow from the pump, while the intake port (B or A) for the reflux to the pump simultaneously are opened gradually by the distribution plate (22). The intake port is connected to the pressure fluid supply to the pump.

15 Claims, 7 Drawing Figures

AXIAL PISTON PUMP

The present invention relates to an axial piston pump comprising a rotatable cylinder block within which at least one piston is mounted slidable in a cylinder and by rotation of the cylinder block is imparted a reciprocating movement, the cylinder by the rotation being brought to gradually changing communication with outlet and inlet openings in a valve or distribution plate which openings in turn are connected with exhaust and intake passages for the pumped medium.

In known hydraulic systems, especially for mobile units, ever increasing numbers of pump circuits are utilized to obtain independent functional operations under simultaneous running, i.e. one hydraulic pump together with an associated circuit is used for each single operation, and all hydraulic pumps are driven by one driving motor. As the pumps which are used have constant displacement, this arrangement implies that the entire pump volume must be circulated by pumping which means that the entire volume is caused to circulate even if no operation is desired to be effected in the circuit. Recently, systems have become available which are operated without complete reflux, which means that 20–30% only of the total volume is delivered via filter to a receptacle while the remainder of the volume is circulated by pumping in a separate circuit. Even if thus some improvement is attained with such a system, there still exists the great drawback that the circulation by pumping of the fluid, such as the hydraulic oil, requires a substantial portion of the driving motor power for a circuit which is not used for any operation. Additional drawbacks inherent to such systems are that tubing for circulation by pumping of the hydraulic fluid and the installation of a directional valve for control of the fluid flow increase the initial costs and complicate the construction. As speed requirement (great volume) does not exist simultaneously with power demand (high pressure), it is necessary, when a large power is being developed, to take charge of, and drain off, a large fluid volume, when a small volume is utilized for the generation of power.

One main object of the present invention is to provide a new type of axial piston pump preferably for hydraulic systems in which every circulation by pumping of the hydraulic fluid can be eliminated, while the same readiness for operation as with known systems is retained. Another important object of the invention is to provide a pump of said kind, the fluid volume of which can be regulated in response to load of, and output from, the pump in order to eliminate the disadvantageous effects described above.

Further objects and advantages and the characteristic features of the axial piston pump according to the invention will become apparent from the following description, considered in connection with the accompanying drawings which illustrate some preferred embodiments and form part of this specification and of which:

Figure 1:
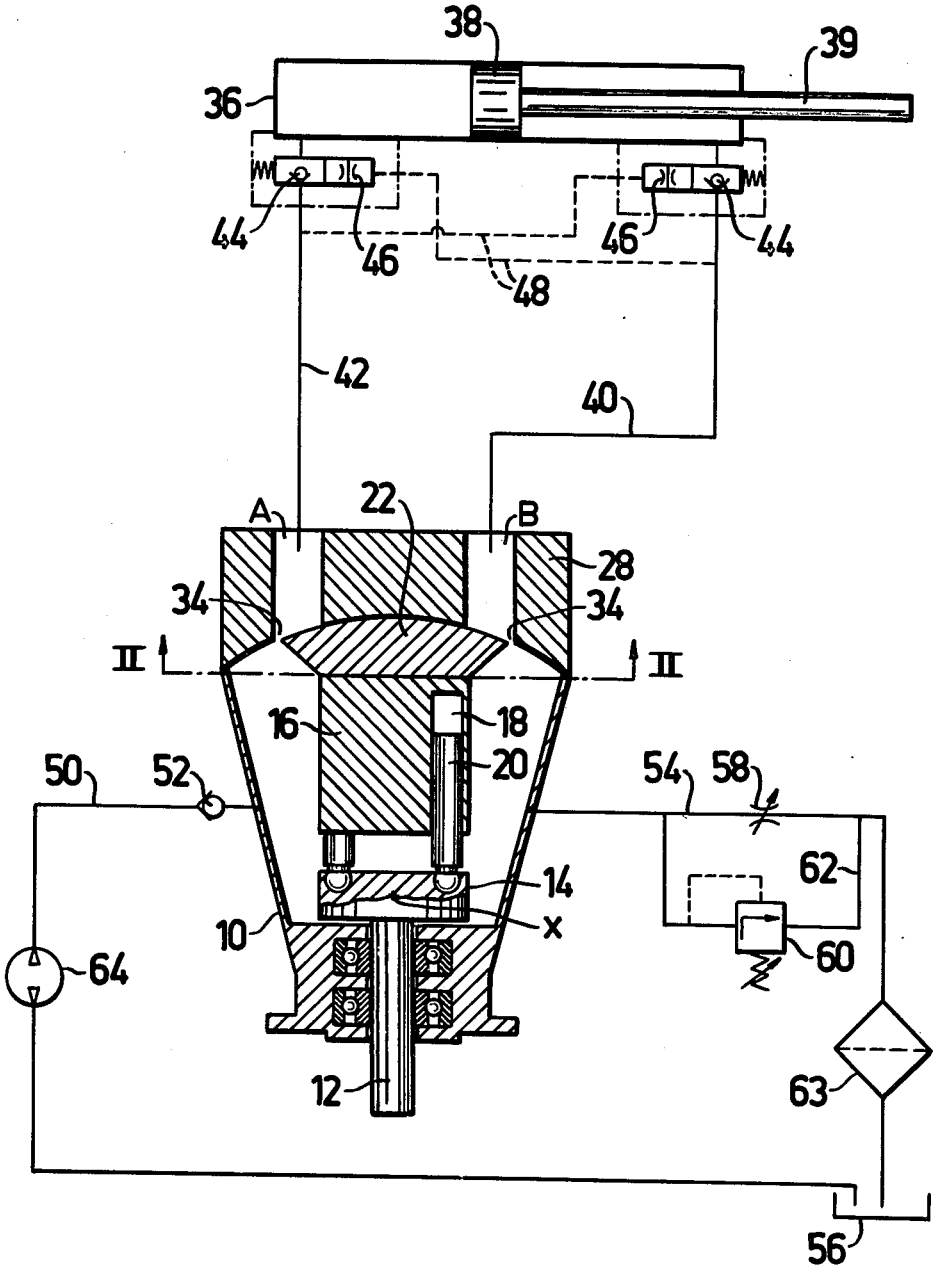
FIG. 1 is a diagrammatic, partly sectional side view of an axial piston pump according to the invention forming part of a circuit for control of a cylinder.
Figure 2:
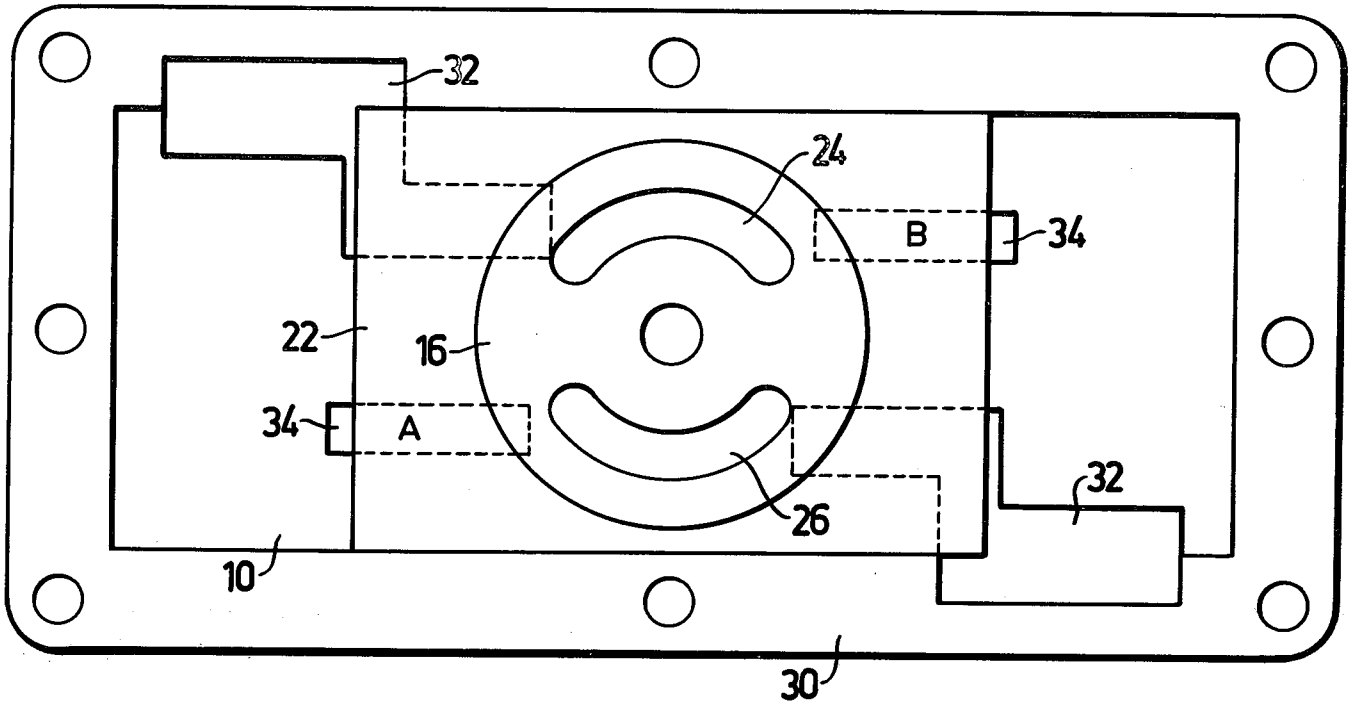
FIG. 2 is a diagrammatic view from below of a value or distribution plate of the pump in relation to the port plate of the pump housing, generally along line II—II of FIG. 1.

The pump shown in FIG. 1 comprises a housing 10 represented diagrammatically and enclosing a rotatably mounted drive shaft 12 with drive shaft flange 14, which drive shaft is actuated by a drive motor not shown here. Pivotably mounted in the housing is a cylinder barrel or block 16 containing at least one cylinder 18 within which a piston 20 is received for reciprocating movement. The pistons 20 are mounted in usual manner in the drive shaft flange 14, e.g., by means of ball-formed bearings so that the cylinder block rotates with the drive shaft flange. The cylinder block 16 can be tilted relatively to the drive shaft flange 14 whereby the pistons on rotation of the cylinder block 16 are imparted a reciprocating movement within the cylinders, the stroke of which movement becomes dependent on the angle between the drive shaft 12 and the cylinder block 16. Disposed overhead of the cylinder block is a valve or distribution plate 22 which is formed with slots 24, 26 (FIGS. 2–4), the pistons moving in outward direction through one of the slots 24, 26 becoming connected with an intake or suction port in the housing and the pistons which are on their way into the bores through the other slot 24,26 being in communication with an exhaust or pressure port in the pump housing 10. The exhaust or pressure port and the reflux or suction port are denoted A and B, respectively, in the figures. The described pump according to the invention has variable or adjustable displacement, i.e. the angle between the drive shaft flange and the cylinder block can be varied to an inclination from 0 to about 25 degrees in both directions from the neutral position shown in FIG. 1 where the angle is 0. The angle is thus varied in the shown embodiment by a tilting displacement of the cylinder block 16 and the distribution plate 22 to the left or the right in the shown figure about the pivot point x. The distribution plate 22 is rotationally stationary and thus does not participate in the rotation of the cylinder block 16.

Figure 3:
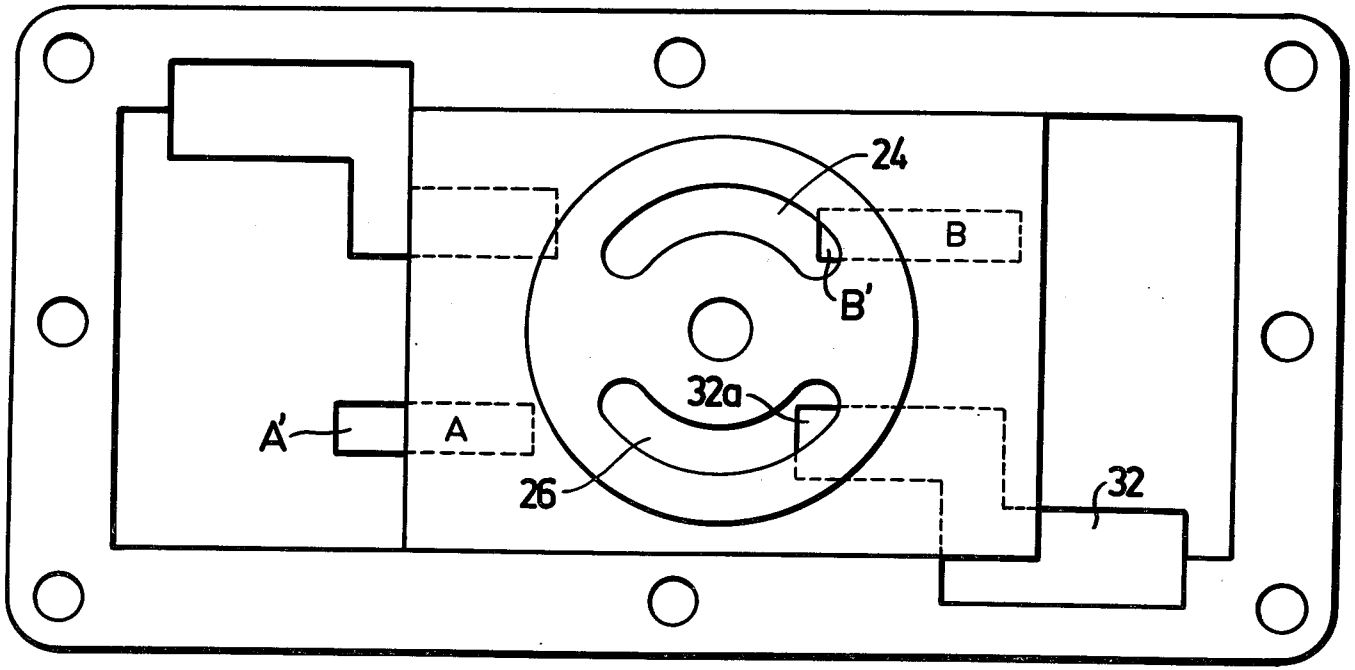
FIGS. 3 and 4 are views corresponding to that of FIG. 2 but with the distribution plate in other positions.
Figure 4:
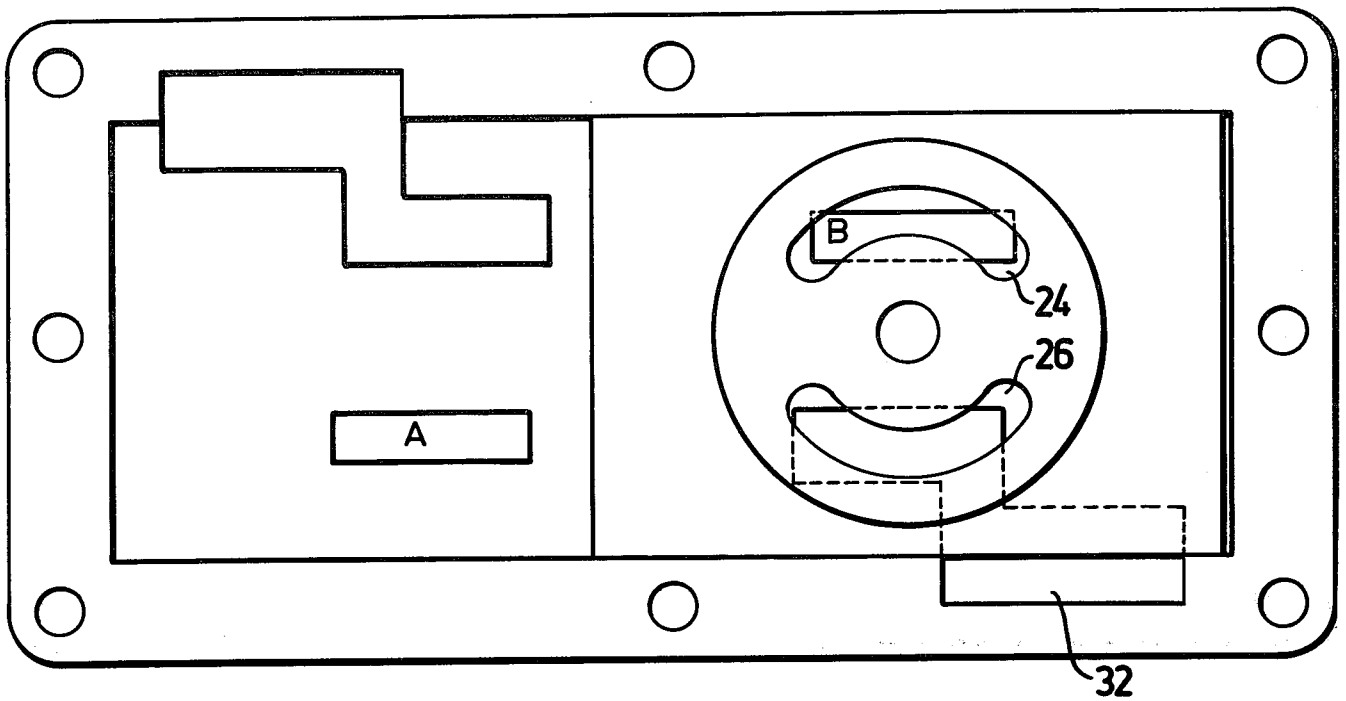

According to the invention, there is positioned outside the distribution plate 22 a stationary port plate 28 in which the reflux and exhaust ports A and B, respectively, are provided. The port plate 28 is fixed to the pump housing and thus does not participate in the angular setting of the cylinder block 16 and the distribution plate 22. From FIG. 2 the positioning of the ports is evident when the distribution plate 22 is in the neutral position of the pump with the angle 0, i.e., the position shown in FIG. 1. The sector surface of the housing 10 at the top portion of the pump is surrounded by a flange 30 by which the port plate 28 is rigidly secured to the pump housing. The distribution plate 22 which extends to tight abutment against the sector surface of the housing 10 contains, as described earlier, the valve slots 24,26, and about these valve slots the sector surface of the cylinder block 16 is indicated in the form of a ring. Further, there are shown diagrammatically port openings 32 for feed oil to the cylinder block 16 and the ports A and B, of which in the following description the port A will be denoted reflux port and the port B exhaust port. Of course, the relation of the ports to one another will be reversed when the direction of rotation is changed, which means that the port B will become the reflux port and the port A the exhaust port. It will be easily understood from FIG. 2 that no fluid, such as oil, in the neutral position is supplied to the ports A, B from the cylinders 18 in the cylinder block 16. However, the distribution plate 22 leaves both in the port A and in the port B a gap 34, the function of which will be described hereinafter. From said FIG. 2 it will be evident also that the feed ports 32 are extended nearer to the centre line of the cylinder block 16 and the valve slots 24,26 than the ports A and B in order not to obtain too small an open area of the feed port 32 when the pumping operation is started, since otherwise cavitation could be caused. When the pumping operation is started, as is illustrated in FIG. 3, fluid is sucked in from the feed opening 32 in the valve slot 26 through the portion 32*a* of the feed opening 32 then coinciding with said slot 26 as the result of the pistons in the cylinders when passing below the valve slot 26 in the valve block 16 performing an inward movement in the cylinders 18 and sucking the fluid inwards from the port opening 32. By continued rotation of the cylinder block 16, the cylinders 18 which are filled with fluid when passing over the valve slot 24 will pump out the fluid through the portion B' laid open of the exhaust port B into duct 40 in FIG. 1. The reflux from the operating circuit streams through duct 42 back to the portion A' of port A is laid open alongside the distribution plate 22 (FIG. 3). FIG. 4 shows the corresponding position with the highest volume to the exhaust port B, i.e., when the cylinder block 16 has been tilted to the right as far as possible in FIG. 1, usually by about 25° relative the center line of the drive shaft flange 14. As is evident from FIG. 4, the feed opening 32 now coincides with the valve slot 26 and the exhaust port B with the valve slot 24 in usual manner. The entire reflux port A is laid open alongside the distribution plate 22.

The shown and described axial shaft pump forms part of a system presented diagrammatically in FIG. 1 and including a control cylinder 36 with piston 38. In the shown embodiment the pressure fluid from the pump is fed through the pipe 40 from the pump 10 to the cylinder 36 and is returned through the pipe 42 from the opposite part of the cylinder. Inserted into each circuit or duct 40, 42 are nonreturn valves 44 and overflow valves 46 which, through pipes 48, are coupled to the reverse circuit to or from, respectively, the cylinder 36. In the shown embodiment, there are also provided a pre-feed pipe 50 with non-return valve 52 and further a return pipe 54 from the pump to a receptacle 56, said pipe 54 containing a throttle valve 58 and an overflow valve 60 with bypass-pipe 62 and filter 63. The pre-feeding may be effected by means of, for example, a separate pump 64 from the receptacle 56.

By the shown arrangement many advantages are obtained with the pump according to the invention when compared with known pumps, as will become evident from the following description: In the neutral position of the pump shown in the FIGS. 1 and 2, no circulation by pumping of the pressure fluid takes place. Therefore, no directional valve is required to direct the flow between the intake and exhaust ducts 40, 42 and also drainage to receptacle is dropped. The feed pressure from the pre-feeding (the pipe 50) of 1.5 MPa, for example, acts through the slots 34 in the ports A and B on the one or the other side, respectively, of the cylinder. Since the pump is set in the angle 0, negligible power only is required to drive the pump in this position, for which reason no slipping clutch device for the pump need be provided. Slipping clutch devices are found in known pumps which devices require power even when no fluid is taken out to any operational circuit because of the circulation by pumping of the fluid. When pumping is started in the pump according to the invention which is shown in FIG. 3, the cylinder block 16 and the distribution plate 22 are tilted only as much as the operation requires, which means that when an operation with little volume is desired, it is possible also with constant number of revolutions of the driving motor to achieve much softer starts, and the operations can be run for a long time at low speed without any negative temperature effects. This should be compared with the pumps described at the outset above where full volume always is present and, therefore, a great flow must be blocked in order to obtain a high pressure while at the same time the major part of the fluid is carried off without being utilized, which results in great heat generation.

Figure 5:
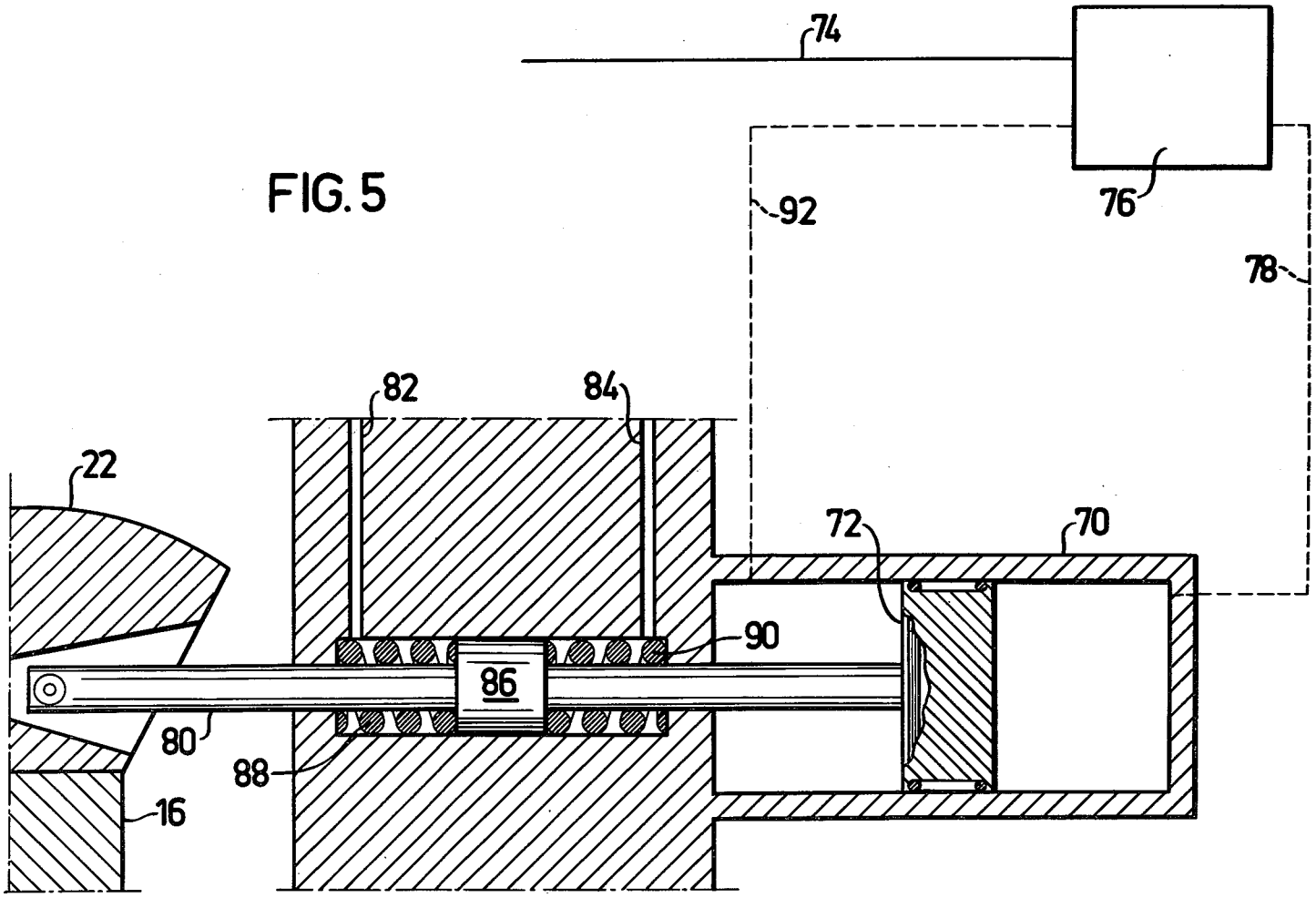
FIG. 5 is a diagrammatic, partly sectional side view of a servo mechanism for control of the pump according to the invention.

When the pressure is increased, the pump is positively guided to a minor angle against the deflecting power in almost the same manner as a piston pump with variable displacement, but the positive guiding continues towards the angle of zero which implies that overflow oil need not arise. Therefore, the power requirement can be less than when pumps with variable displacement are used. The positive guiding may be effected by means of, for example, the servo mechanism shown in FIG. 5 for controlling and centering the tilting of the pump. Hydraulic fluid is supplied to servo cylinder 70 with servo piston 72 through, for example, pipe 74 and a servo control device 76. The servo fluid may be, for example, a branch portion of the pre-feed fluid (the pipe 50) to the pump in FIG. 1. When the servo valve is opened for pressure via pipe 78 to the rear side of the piston 72, this piston 72 over its piston rod 80 acts on the distribution plate 22 coupled to the piston rod 80 together with the cylinder block 16. Thereby, the outward inclination of the pump is increased and pumping to the port A is started. Via bores 82, 84 leading to the ports or openings A and B, respectively, this piston 86 between centering springs 88, 90 scans the working pressure of the pump. When the working pressure rises, the piston rod 80 is displaced against the pressure in the servo cylinder 70, i.e. the control power, by the higher pressure acting on the piston 86. When the pressure reaches the desired highest value, the pump is returned so that the pumping is discontinued even if the servo pressure is still active in the pipe 78. The same holds true when the pressure fluid instead is supplied to the servo pipe on the front side of the piston, viz. through pipe 92. To compensate for the different piston areas of the servo piston 72, the piston 86 also may have different piston areas on its one and other side (not shown).

In the embodiment of FIG. 1, the ports A and B are exhaust or reflux ports, depending on in what direction the cylinder block 16 and the distribution member 22 are inclined. To compensate for the different piston areas of the piston 38 because of the existence of the piston rod 39, the inclination movement in the one direction, for example towards the right in FIG. 1, may be limited by means of a mechanical stopper (not shown) so as to obtain a lower maximum volume for the pump flow to the front side (with the piston rod 39) of the piston 38 which side has the smallest area. In this way the same speed is obtained for both directions of movement of the cylinder 36. The non-return valves 44 and overflow valves 46 in each pipe 40,42 are preferably devised as sleeve type valves so that overflow of fluid from one side to the other results in slow opening of the non-return valve so as to prevent sudden pressure drop to occur in the reflux fluid.

The pre-feed pressure is not an absolute necessity in the system, but it renders many advantages in a system having a plurality of operative functions. As described, it can be used through the servo control device 76 to select direction and speed, in which connection also a very small risk of cavitation exists. Oil exchange and filtering are effected, as described, via throttle valve 58 and pressure limiting valve 60 and filter 63 to receptacle 56.

Figure 6:
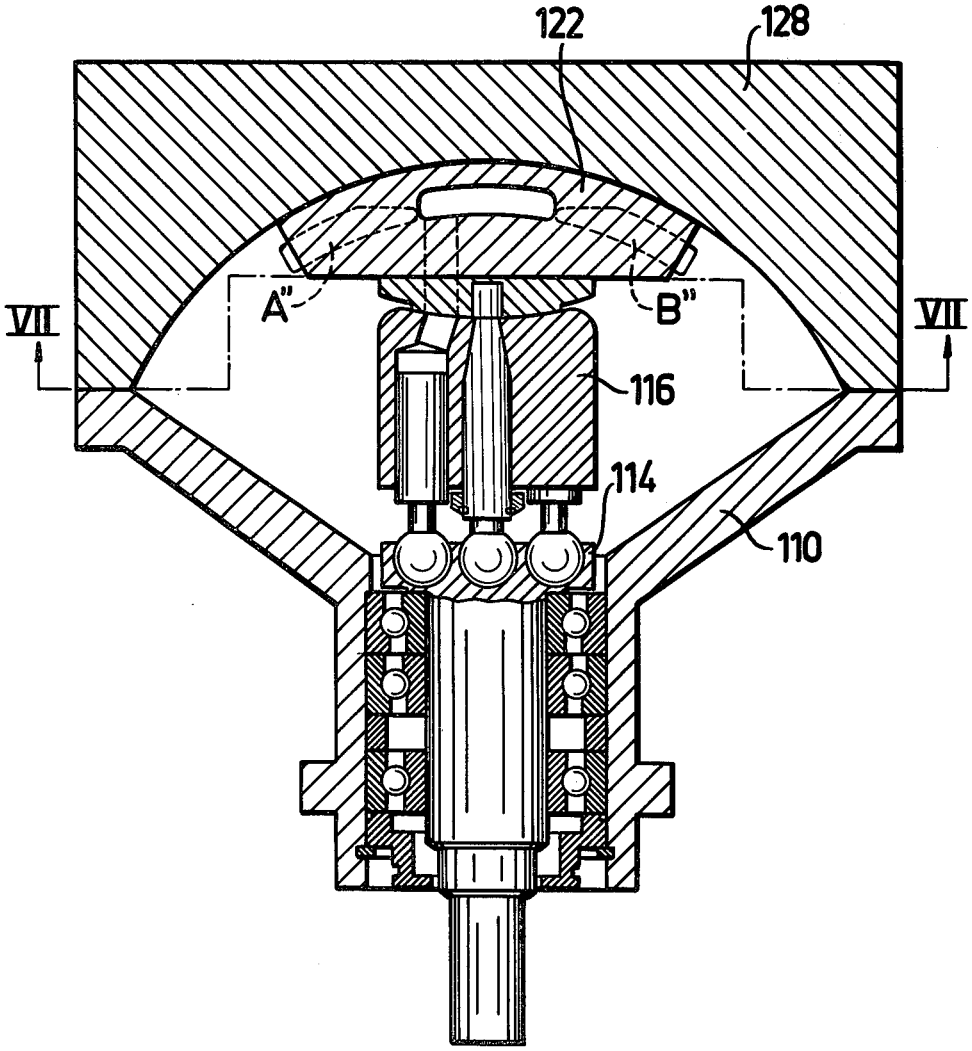
FIGS. 6 and 7 show another embodiment represented in similar manner as the preceding embodiment.
Figure 7:
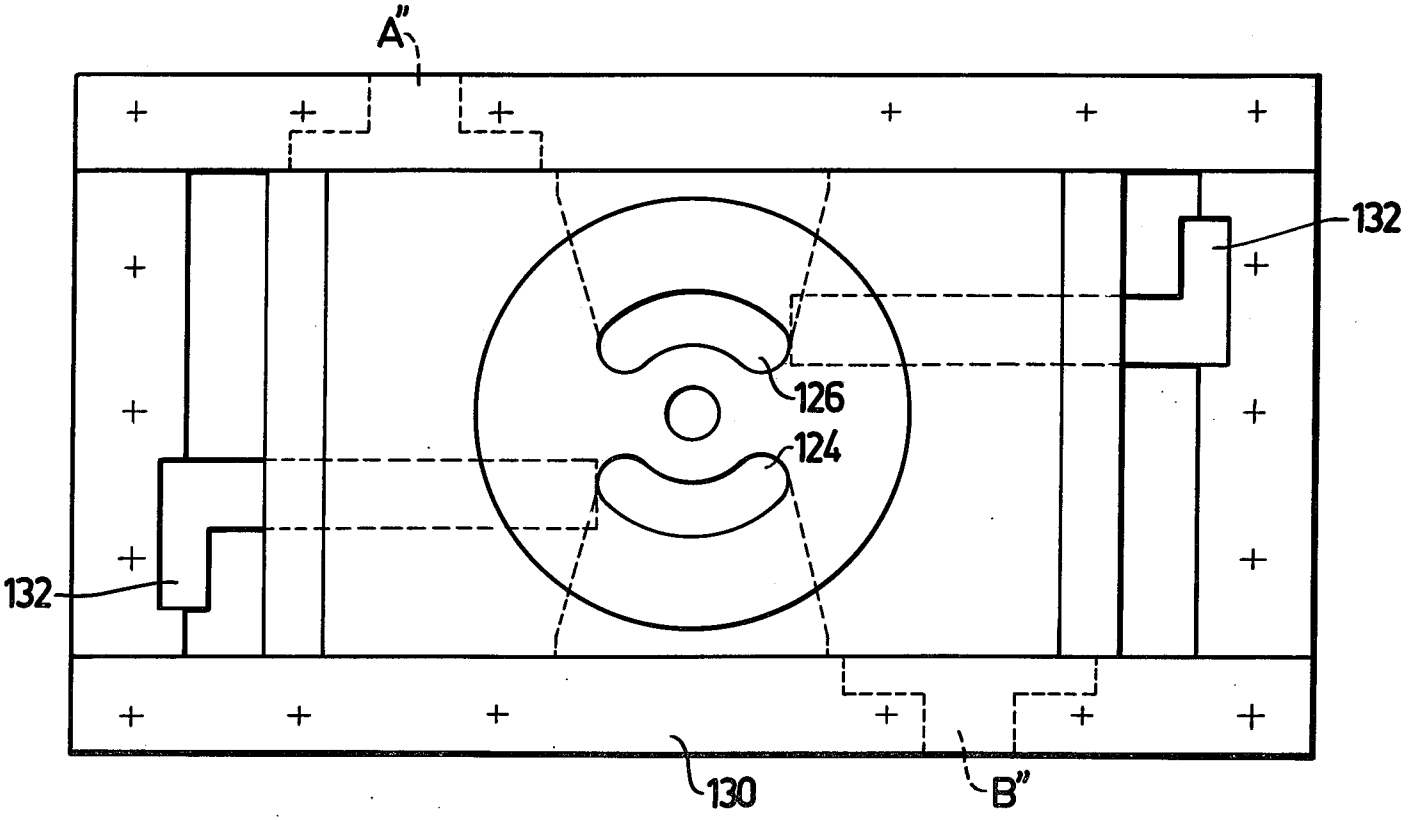

For the hydraulic balancing of the distribution plate 122 it may be suitable to position the exhaust ports as is evident from FIGS. 6 and 7 in order to try to get the hydraulic balance against the opposite surface. FIG. 6 shows a view similar to FIG. 1 of a modified embodiment and FIG. 7 shows a section along line VII—VII in FIG. 6, the same reference numerals being employed as before under addition of the number one hundred. The exhausts A″ and B″ may here open on both sides of the distribution plate 122. The passage of each port to the associated intake duct 132 is realized as before. To equalize the pressure which in axial direction acts against the bearing, the port in this position becomes closed against the sector surface, and balance can be reached.

As becomes evident from the preceding description, the drawbacks which generally are inherent to all known systems with directional valves, viz.:

1. interference between loads within the same pumping circuit,
2. no direct interaction between deflection of the control rod and speed,
3. great losses which, in addition, must be cooled off, will be eliminated in the system according to the invention.

For item 1 this is achieved by means of separate pumping circuits to the operative functions when simultaneous running is required.

Regarding item 2 the system according to the invention affords the possibility of direct reciprocity between deflection of the control rod and the speed of the operative function irrespective of the magnitude of the load.

The losses according to item 3 can be reduced considerably in the present system depending on the factors which are set forth in the description of the functional operations.

As is evident from the aforesaid, it is essential for the correct operation of the pump that the port plate comprises at least one feed opening for supply of pressure fluid to the pump and that the arrangement of the exhaust and intake channels and the intake port in the stationary port plate is of such a kind that the outlet and inlet slots or apertures by outward inclination of the distribution plate from zero position are brought to gradually increasing communication with the feed opening and the exhaust channel (A or B) for the discharge of fluid from the pump, the reflux channel (B or A) for the reflux to the pump becoming opened gradually simultaneously by the distribution plate, which reflux channel is connected to the pressure fluid feed to the pump, more distincly the pump housing 10, which serves as reservoir for the pressure fluid. In this way the volume difference between the two faces of the piston 38 of the pressure fluid cylinder 36 is prevented from influencing the operative function.

I claim:

1. In an axial piston pump comprising:

(a) a drive plate (b) a rotatable cylinder block tiltable relative to said drive plate in at least one direction (c) at least one piston mounted slidably in a cylinder of said cylinder block, said piston having a reciprocating movement imparted thereto upon rotation of said cylinder block when said cylinder block is tilted, relative to said drive plate, out of a neutral position in which no pumping is effected, (d) a distribution plate adjustable jointly with said cylinder block and including two slots which act as inlet and outlet slots respectively, depending upon the direction of tilting of the cylinder block, (e) a stationary port plate comprising exhaust and reflux ports respectively for the outflow of pumped fluid from the pump to an hydraulic system and for reflux of the used fluid from said hydraulic system to a hydraulic reservoir, one of said slots of said distribution plate, acting as an outlet slot by the adjustment of the distribution plate, being brought into gradually increasing communication with that said port of the said port plate which is serving as an exhaust port as a consequence of the tilting of said distribution plate out of neutral position, the improvement which comprises, in combination:

(i) said port plate has at least one additional and separate feed opening located in said port plate for each tilting direction for supply of fluid to the pump, (ii) the positioning of said exhaust and reflux ports and said feed opening of said port plate is such that said outlet and inlet slots of said distribution plate, as a result of said tilting of said distribution plate out of neutral position, are brought into gradually increasing communication with said feed opening and said exhaust port for outflow of fluid from the pump, (iii) the reflux port for reflux of fluid to the hydraulic reservoir is gradually opened by said distribution plate, and (iv) said reflux port and said feed opening are placed in communication with a housing for the pump serving as a hydraulic reservoir for the pump.

2. An axial piston pump, as claimed in claim 1, wherein said distribution plate is so arranged that, when in neutral position, it leaves open a portion of said exhaust and reflux ports of said port plate.

3. An axial piston pump, as claimed in claim 1, wherein said feed opening of said port plate is opened prior to opening of said exhaust port of said port plate when the angle of inclination is increased from said neutral position.

4. An axial piston pump, as claimed in claim 1, comprising a further pump forming part of a pre-feed circuit for maintenance of a pre-feed pressure in the pumping circuit.

5. An axial piston pump, as claimed in claim 4, comprising a servo mechanism for tilting of said cylinder block and said distribution plate, said servo mechanism having a servo piston coupled to said distribution plate, and a control circuit for actuating said sero piston via a servo regulator, said servo piston being also actuated by the working fluid pressure of the pump such that the servo piston is displaced against the servo control pressure when said pressure is exceeded by the working fluid pressure.

6. An axial piston pump, as claimed in claim 5, wherein said pre-feed pressure is used as servo control pressure.

7. An axial piston pump, as claimed in claim 5, wherein said reflux port and said exhaust port are in communication with one and the other side, respectively, of a piston provided on a piston rod of said servo piston.

8. An axial piston pump, as claimed in claim 7, wherein said pre-feed pressure is used as servo control pressure.

9. An axial piston pump comprising a rotatable cylinder block tiltable relatively to a drive plate in at least one direction, at least one piston which is mounted slidably in a cylinder in the cylinder block and which is imparted a reciprocating movement on rotation of the cylinder block when that cylinder block is tilted relatively to the drive plate from a neutral or null position in which no pumping is effected, a distribution plate adjustable jointly with the cylinder block and formed with two slots which act as inlet and outlet slots respectively depending on the tilting direction of the cylinder block, and a stationary port plate comprising exhaust and reflux ports respectively for the outflow of the pumped fluid from the pump to an hydraulic system and the reflux of the used fluid from the hydraulic system to an hydraulic reservoir; one of the slots in the distribution plate acting as an outlet slot by the adjustment of the distribution plate being brought into gradually increasing communication with that port in the stationary port plate which is used as an exhaust port as a consequence of the tilting of the distribution plate from neutral position, characterized in that the stationary port plate comprises at least one additional and separate feed opening or port located in the stationary port plate for each tilting direction for supply of fluid to the pump, that the disposal of the exhaust and reflux ports and the feed opening in the stationary port plate is of such kind that the outlet and inlet slots of the distribution plate in consequence of said tilting of the distribution plate from neutral position are brought in gradually increasing communication with the feed opening and the exhaust port for the outflow from the pump, that the reflux port for the reflux to the hydraulic reservoir simultaneously being opened gradually by the distribution plate, and that the reflux port and the feed opening are connected to the pump housing which functions as an hydraulic reservoir for the pump.

10. The pump according to claim 9 characterized in that a gap remains open in both the reflux and the exhaust ports.

11. The pump according to claim 9 characterized in that the feed opening for supply of fluid to the cylinder or cylinders is opened prior than the exhaust port of the pump when the angle of inclination is increased from the null position.

12. The pump according to claim 9 characterized in that another pump forms part of a pre-feed circuit for maintenance of a pre-feed pressure in the pumping circuit.

13. The pump according to claim 12 characterized in that the outward tilting or adjustment of the cylinder block and the distribution plate is effected by means of a servo mechanism within which a servo piston coupled to the distribution plate is actuated by a control circuit via a servo regulator, the servo piston also being actuated by the working pressure of the pump in such a manner that the servo piston is displaced against the servo control pressure when this pressure is exceeded by the working pressure.

14. The pump according to claim 13 characterized in that the reflux and exhaust ports of the pump are connected to one and the other side, respectively, of a piston provided on the piston rod of the servo piston.

15. The pump according to claim 14 characterized in that the pre-feed pressure is used as servo control pressure.

* * * * *